US011117177B2

(12) United States Patent
Ikawa et al.

(10) Patent No.: US 11,117,177 B2
(45) Date of Patent: Sep. 14, 2021

(54) SPINNING FORMING METHOD

(71) Applicant: KAWASAKI JUKOGYO KABUSHIKI KAISHA, Kobe (JP)

(72) Inventors: Ken Ikawa, Kobe (JP); Yoshihide Imamura, Kobe (JP); Kohei Mikami, Akashi (JP); Hayato Iwasaki, Kobe (JP); Takeo Hirakawa, Kakogawa (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 237 days.

(21) Appl. No.: 16/317,944

(22) PCT Filed: Jul. 11, 2017

(86) PCT No.: PCT/JP2017/025261
§ 371 (c)(1),
(2) Date: Jan. 15, 2019

(87) PCT Pub. No.: WO2018/012494
PCT Pub. Date: Jan. 18, 2018

(65) Prior Publication Data

US 2020/0298299 A1 Sep. 24, 2020

(30) Foreign Application Priority Data

Jul. 13, 2016 (JP) ..... JP2016-138212

(51) Int. Cl.
*B21D 22/18* (2006.01)
*B21D 22/14* (2006.01)

(52) U.S. Cl.
CPC ..... *B21D 22/18* (2013.01); *B21D 22/14* (2013.01)

(58) Field of Classification Search
CPC ..... B21D 22/14; B21D 22/16; B21D 22/18; B21D 37/16; B21D 53/26; B21H 1/04
See application file for complete search history.

(56) References Cited

U.S. PATENT DOCUMENTS 1,795,379 A * 3/1931 Schmidt ..... B21D 22/18 72/84
3,815,395 A * 6/1974 Sass ..... B21D 22/18 72/69

(Continued)

FOREIGN PATENT DOCUMENTS

JP 57-165129 A * 10/1982 ..... B21D 22/16
JP 2015-202501 A 11/2015

(Continued)

OTHER PUBLICATIONS

Translation, WO2015/16634 A1, Kabe et al., Nov. 2015.*

*Primary Examiner* — Edward T Tolan
(74) *Attorney, Agent, or Firm* — Oliff PLC

(57) ABSTRACT

A spinning forming method includes: preparing a plate including a back surface at which a ring-shaped projection is formed along an outer peripheral edge of the plate, a ratio of a thickness at a reference position of the plate to a thickness at a tip end of the projection being 0.7 or less, the reference position being a position where an inclination of a portion of the back surface which portion extends toward the tip end of the projection is 45° or more; rotating the plate; moving a processing tool outward in a radial direction from an inner side of the projection to a position above the projection while pressing the processing tool against a front surface of the plate that is rotating; and locally heating a portion of the plate against which portion the processing tool is pressed.

12 Claims, 7 Drawing Sheets

(56) References Cited

U.S. PATENT DOCUMENTS

| | | | | | |
|---|---|---|---|---|---|
| 4,170,889 | A | * | 10/1979 | Tanimoto | B21D 22/185 72/83 |
| 6,006,569 | A | * | 12/1999 | Shrayer | B21D 22/14 72/69 |
| 6,158,261 | A | * | 12/2000 | Utyashev | B21H 1/04 72/69 |
| 2017/0021405 | A1 | | 1/2017 | Kabe et al. | |
| 2017/0043389 | A1 | | 2/2017 | Imamura et al. | |

FOREIGN PATENT DOCUMENTS

| | | | | | |
|---|---|---|---|---|---|
| JP | 2015-205306 | A | | 11/2015 | |
| JP | 2015-208766 | A | | 11/2015 | |
| WO | 2015/155954 | A1 | | 10/2015 | |
| WO | 2015/166634 | A1 | * | 11/2015 | B21D 22/14 |

* cited by examiner

SPINNING FORMING METHOD

TECHNICAL FIELD

The present invention relates to a spinning forming method for forming a plate in a desired shape while rotating the plate.

BACKGROUND ART

Products having various axially-symmetric shapes have been manufactured by a spinning forming method. For example, PTL 1 discloses a spinning forming method for manufacturing a hollow structure including an inward swelling portion at a large-diameter end portion of a tapered portion.

Specifically, the spinning forming method disclosed in PTL 1 includes an ironing step and a thickness increasing step. In the ironing step, while pressing a processing tool against a surface of a plate that is rotating, the processing tool is moved outward in a radial direction, and a portion of the plate against which portion the processing tool is pressed is locally heated. Thus, a predetermined range of the plate becomes a tapered portion. In the thickness increasing step, while locally heating a peripheral portion of the tapered portion, a forming roller is pressed against the peripheral portion of the tapered portion such that the peripheral portion of the tapered portion swells inward. Thus, the inward swelling portion is formed at the large-diameter end portion of the tapered portion.

CITATION LIST

Patent Literature

PTL 1: Japanese Laid-Open Patent Application Publication No. 2015-205306

SUMMARY OF INVENTION

Technical Problem

However, the spinning forming method disclosed in PTL 1 requires the ironing step using the processing tool and the thickness increasing step using the forming roller. Therefore, manufacturing the hollow structure including the inward swelling portion at the large-diameter end portion of the tapered portion by a simpler method is desired.

An object of the present invention is to provide a spinning forming method capable of easily manufacturing a hollow structure including an inward swelling portion at a large-diameter end portion of a tapered portion.

Solution to Problem

To solve the above problem, the inventors of the present invention have thought that by performing bending by utilizing a processing tool used in ironing, the tapered portion and the inward swelling portion can be formed through continuous work. The inventors of the present invention have diligently studied, and as a result, found conditions for realizing it. The present invention was made from this point of view.

To be specific, the spinning forming method of the present invention includes: preparing a plate including a back surface at which a ring-shaped projection is formed along an outer peripheral edge of the plate, a ratio of a thickness at a reference position of the plate to a thickness at a tip end of the projection being 0.7 or less, the reference position being a position where an inclination of a portion of the back surface which portion extends toward the tip end of the projection is 45° or more; rotating the plate; moving a processing tool outward in a radial direction from an inner side of the projection to a position above the projection while pressing the processing tool against a front surface of the plate that is rotating; and locally heating a portion of the plate against which portion the processing tool is pressed.

According to the above configuration, the ironing is performed at the inner side of the projection by the pressing of the processing tool. With this, a predetermined range at the inner side of the projection of the plate becomes a tapered portion. The thickness at the reference position that is a base point of an inner peripheral surface of the ring-shaped projection is adequately smaller than the thickness at the tip end of the projection. In addition, the portion of the plate against which portion the processing tool is pressed is locally heated. Therefore, when the processing tool passes through the position above the reference position, the bending is performed at a fulcrum that is a portion located at the inner side of and adjacent to the reference position and softened by local heating, and the projection tilts toward a radially inner side. With this, an inward swelling portion is formed at a large-diameter end portion of the tapered portion. To be specific, the ironing and the bending can be sequentially performed only by continuously moving the processing tool outward in the radial direction. Therefore, a hollow structure including the inward swelling portion at the large-diameter end portion of the tapered portion can be easily manufactured.

The portion of the plate against which portion the processing tool is pressed may be heated from the front surface side of the plate. According to this configuration, the bending at the fulcrum located near the reference position can be more satisfactorily performed than a case where the plate is heated from the back surface side.

The plate may include a thinning portion at the inner side of the projection, the thinning portion decreasing in thickness toward a radially outer side. According to this configuration, since the plate decreases in thickness as the ironing proceeds, a load acting on the processing tool during the ironing can be gradually reduced.

For example, the front surface of the plate may be flat at least from a forming start point to the position above the projection, and the back surface of the plate may include an outward-facing inclined surface between the forming start point and the projection, the outward-facing inclined surface being inclined so as to approach the front surface toward the radially outer side.

The back surface of the plate may include an inward-facing inclined surface between the outward-facing inclined surface and the projection, the inward-facing inclined surface being inclined so as to be away from the front surface toward the radially outer side. According to this configuration, a concave portion is formed at the back surface of the plate so as to be located at the inner side of the reference position. As a result, especially in a case where the plate is heated from the front surface side, when the ironing shifts to the bending, the heat can deeply reach a portion close to the back surface in a normal direction of the tapered portion. With this, the portion located at the inner side of and adjacent to the reference position is kept at a high temperature, and the bending at this portion as the fulcrum can be further satisfactorily performed.

The ratio of the thickness at the reference position to the thickness at the tip end of the projection may be 0.2 or more. If the ratio of the thickness at the reference position to the thickness at the tip end of the projection of the plate is too low, the plate may break during the bending depending on the material of the plate. However, the possibility of such break can be reduced when the ratio is 0.2 or more.

For example, the plate may be made of titanium alloy.

For example, a minimum thickness of the plate may be 10 mm or more.

Advantageous Effects of Invention

According to the present invention, the hollow structure including the inward swelling portion at the large-diameter end portion of the tapered portion can be easily manufactured.

DESCRIPTION OF EMBODIMENTS

Figure 1:
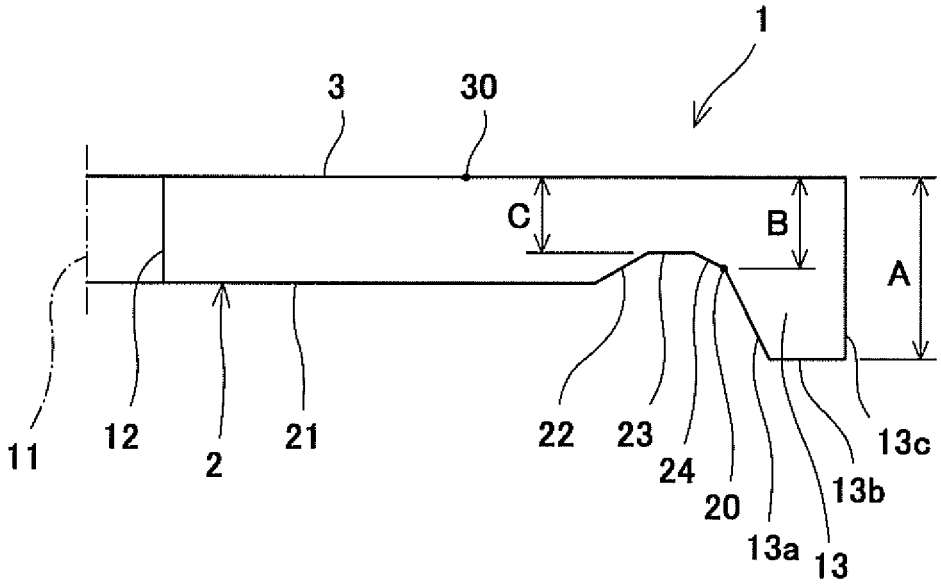
FIG. 1 is a cross-sectional view of a plate used in a spinning forming method according to one embodiment of the present invention.
Figure 2A:
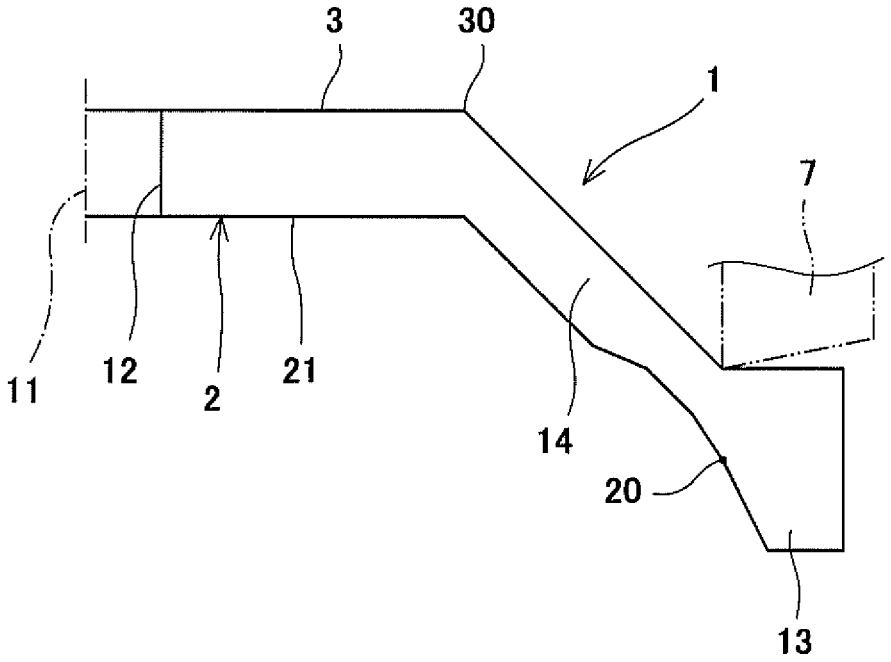
FIGS. 2A and 2B are diagrams for explaining the spinning forming method.
Figure 2B:
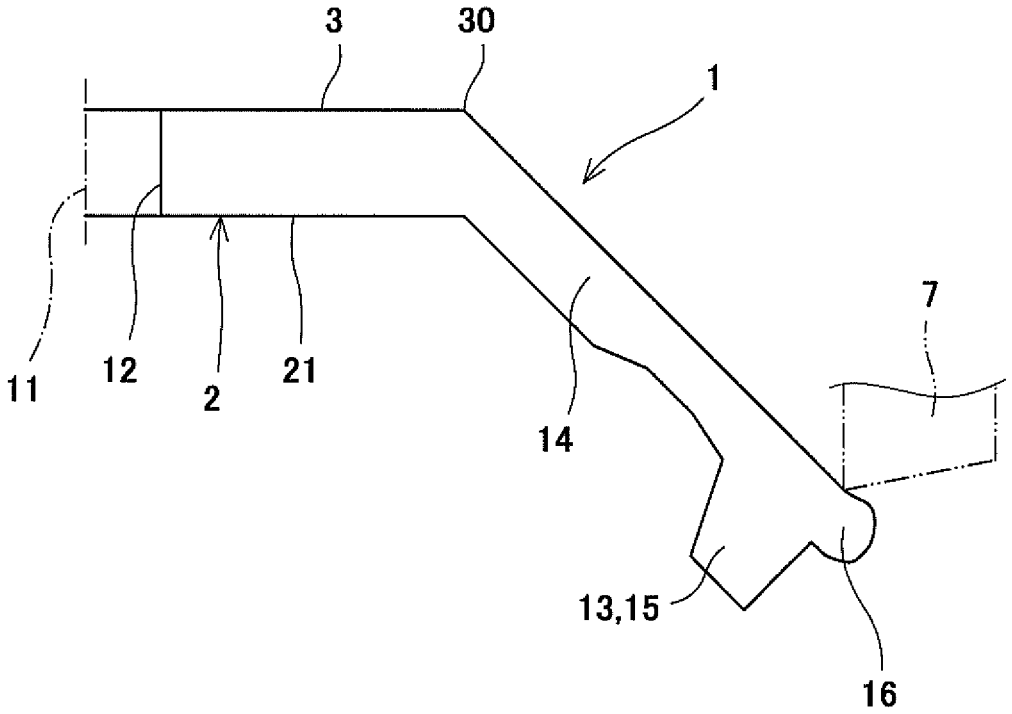

A spinning forming method according to one embodiment of the present invention is a method for manufacturing a hollow structure including an inward swelling portion 15 at a large-diameter end portion of a tapered portion 14 as shown in FIG. 2B. A cross-sectional shape of the tapered portion 14 may be a linear shape or a curved shape. In the spinning forming method of the present embodiment, first, a plate 1 shown in FIG. 1 is prepared.

The plate 1 includes a back surface 2 and a front surface 3. The back surface 2 becomes an inner surface of the hollow structure shown in FIG. 2B, and the front surface 3 becomes an outer surface of the hollow structure. The plate 1 is symmetrical around a central axis 11 and has a circular contour in a plan view. A circular through hole 12 is provided at a center of the plate 1. The through hole 12 is utilized for positioning with respect to a below-described receiving jig 52. However, the plate 1 does not necessarily have to be provided with the through hole 12. A material of the plate 1 is not especially limited but is, for example, titanium alloy.

A ring-shaped projection 13 is formed at the back surface 2 of the plate 1 along an outer peripheral edge of the plate 1. In the present embodiment, the projection 13 is formed so as to constitute a part of an outer peripheral surface of the plate 1. However, the projection 13 may be formed so as to be separated inward from the outer peripheral surface of the plate 1. Further, the projection 13 does not necessarily have to be continuous in a circumferential direction and may be constituted by a plurality of circular-arc pieces separated from one another in the circumferential direction.

It is desirable that the front surface 3 of the plate 1 be flat at least from a forming start point 30 to a position above the projection 13. The forming start point 30 is a position on the front surface 3 of the plate 1 against which position a below-described processing tool 7 is first pressed. To be specific, a predetermined range from the forming start point 30 to an outer side of the forming start point 30 becomes the tapered portion 14 (see FIG. 2A).

In the present embodiment, the entire front surface 3 is flat. However, the front surface 3 may be concave or bulge at an inner side of the forming start point 30. Or, when the projection 13 is formed so as to be separated inward from the outer peripheral surface of the plate 1, the front surface 3 may be concave or bulge at a position between the projection 13 and the outer peripheral surface of the plate 1.

More specifically, the back surface 2 includes a reference surface 21, an outward-facing inclined surface 22, an annular surface 23, and an inward-facing inclined surface 24 which are located at the inner side of the projection 13. These surfaces 21 to 24 are lined up in this order from a center side to the outer side.

The reference surface 21 and the annular surface 23 are parallel to the front surface 3. The annular surface 23 is located closer to the front surface 3 than the reference surface 21. To be specific, a thickness C between the annular surface 23 and the front surface 3 is a minimum thickness of the plate 1. The minimum thickness of the plate 1 is, for example, 10 mm or more.

The outward-facing inclined surface 22 exists between the forming start point 30 of the front surface 3 and the projection 13. In the present embodiment, an outer peripheral edge of the reference surface 21 is located at a radially outer side of a position right under the forming start point 30 of the front surface 3. However, the outer peripheral edge of the reference surface 21 may be located right under the forming start point 30 of the front surface 3 or may be located at a radially inner side of the position right under the forming start point 30.

The outward-facing inclined surface 22 is inclined from the outer peripheral edge of the reference surface 21 so as to approach the front surface 3 toward the radially outer side. To be specific, a portion between the outward-facing inclined surface 22 and the front surface 3 is a thinning portion that decreases in thickness toward the radially outer side. An inclination angle of the outward-facing inclined surface 22 with respect to the front surface 3 is relatively small (for example, 30° or less). The annular surface 23 connects an outer peripheral edge of the outward-facing inclined surface 22 and an inner peripheral edge of the inward-facing inclined surface 24. However, the annular surface 23 may be omitted, and the outer peripheral edge of the outward-facing inclined surface 22 may be directly connected to the inner peripheral edge of the inward-facing inclined surface 24.

The inward-facing inclined surface 24 existing between the outward-facing inclined surface 22 and the projection 13 is inclined from an outer peripheral edge of the annular surface 23 so as to be away from the front surface 3 toward the radially outer side. An inclination angle of the inward-facing inclined surface 24 with respect to the front surface 3 is relatively small (for example, 30° or less).

In the present embodiment, a cross-sectional shape of the projection 13 is a substantially trapezoidal shape that is pointed downward. To be specific, the projection 13 includes: a tip end surface 13*b* parallel to the front surface 3 of the plate 1; a tubular outer peripheral surface 13*c* located on the outer peripheral edge of the plate 1; and an inner peripheral surface 13*a* inclined so as to approach the outer peripheral surface 13*c* toward the tip end surface 13*b*. Each of the inner peripheral surface 13*a* and the tip end surface 13*b* is also a part of the back surface 2 of the plate 1. The outer peripheral surface 13*c* may be inclined so as to approach the inner peripheral surface 13*a* toward the tip end surface 13*b*. In this case, the outer peripheral surface 13*c* is also a part of the back surface 2 of the plate 1. An inclination angle of the inner peripheral surface 13*a* with respect to the front surface 3 is, for example, 60° to 65°.

The plate 1 is configured such that a ratio R (R=B/A) of B to A is 0.7 or less, where A denotes a thickness at a tip end of the projection 13, and B denotes a thickness at a reference position 20 that is a position where an inclination of a portion of the back surface 2 which portion extends toward the tip end of the projection 13 is 45° or more. In the present embodiment, the reference position 20 is an intersection point of the inward-facing inclined surface 24 and the inner peripheral surface 13*a* of the projection 13.

Figure 3:
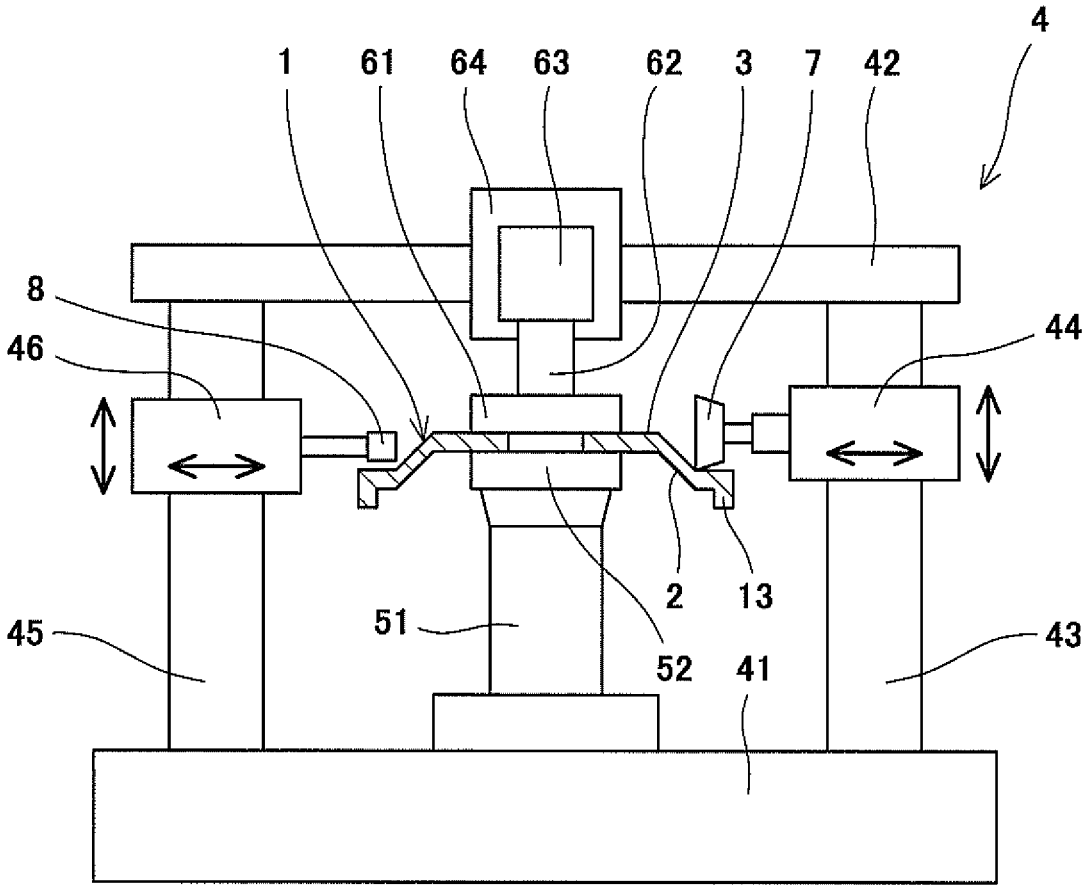
FIG. 3 is a schematic configuration diagram of a spinning forming device configured to execute the spinning forming method.

In the spinning forming method of the present embodiment, after the plate 1 is prepared, ironing and bending are performed while rotating the plate 1 by using a spinning forming device 4 shown in FIG. 3. For simplifying the drawings, FIG. 3 shows a simplified shape of the plate 1.

Specifically, the spinning forming device 4 includes: a rotating shaft 51 configured to rotate the plate 1; the receiving jig 52 interposed between the rotating shaft 51 and the plate 1; and a fixing jig 61. The receiving jig 52 is attached to the rotating shaft 51 and supports a center portion of the plate 1, and the fixing jig 61 sandwiches the plate 1 together with the receiving jig 52. The spinning forming device 4 further includes: the processing tool 7 configured to be pressed against the front surface of the plate 1; and a heater 8 configured to locally heat a portion of the plate 1 against which portion the processing tool 7 is pressed.

In the present embodiment, the heater 8 locally heats a part (the portion against which the processing tool 7 is pressed) of the plate 1 by induction heating. However, the heater 8 may locally heat a part of the plate 1 by laser. Or, the heater 8 configured to locally heat a part of the plate 1 may be a gas burner or the like. Further, in the present embodiment, the heater 8 is arranged so as to face the front surface 3 of the plate 1. To be specific, the heater 8 heats the portion of the plate 1 against which portion the processing tool 7 is pressed, from the front surface 3 side of the plate 1. The heating by the heater 8 is performed simultaneously with the pressing by the processing tool 7. It should be noted that the heating by the heater 8 may be performed continuously or intermittently while the processing tool 7 is pressed against the plate 1.

In the present embodiment, an axial direction of the rotating shaft 51 is a vertical direction. However, the axial direction of the rotating shaft 51 may be a horizontal direction or an oblique direction. A lower portion of the rotating shaft 51 is supported by a base 41, and the rotating shaft 51 is rotated by a motor, not shown. An upper surface of the rotating shaft 51 is flat, and the receiving jig 52 is fixed to the upper surface.

The fixing jig 61 is attached to a pressurizing rod 62. The pressurizing rod 62 is rotatably supported by a supporting portion 63. The supporting portion 63 is driven by a driving portion 64 in an upward/downward direction. The driving portion 64 is attached to a frame 42 arranged above the rotating shaft 51. It should be noted that the fixing jig 61 may be omitted, and the plate 1 may be directly fixed to the receiving jig 52 by, for example, bolts.

The processing tool 7 is moved outward in the radial direction while being pressed against the front surface 3 of the plate 1 that is rotating. In the present embodiment, used as the processing tool 7 is a roller that follows the rotation of the plate 1 to rotate and has a trapezoidal cross section. However, the roller used as the processing tool 7 may have a rhombic cross section or a long round cross section. The processing tool 7 may be, for example, a spatula.

More specifically, the processing tool 7 is moved in the radial direction of the rotating shaft 51 by a first radial direction movement mechanism 44 and also moved in the axial direction of the rotating shaft 51 by a first axial direction movement mechanism 43 through the first radial direction movement mechanism 44. The first axial direction movement mechanism 43 extends so as to couple the base 41 and the frame 42.

During the forming, the heater 8 is arranged on substantially the same circumference as the processing tool 7 and is moved in synchronization with the processing tool 7. More specifically, the heater 8 is moved in the radial direction of the rotating shaft 51 by a second radial direction movement mechanism 46 and also moved in the axial direction of the rotating shaft 51 by a second axial direction movement mechanism 45 through the second radial direction movement mechanism 46. The second axial direction movement mechanism 45 extends so as to couple the base 41 and the frame 42.

A relative positional relation between the heater 8 and the processing tool 7 in the circumferential direction of the rotating shaft 51 is not especially limited. For example, the heater 8 may be arranged at a position right opposite to the processing tool 7 across the rotating shaft 51 or may be arranged at a position displaced from the position right opposite to the processing tool 7 across the rotating shaft 51 (for example, a position away from the processing tool 7 by 90° in the circumferential direction of the rotating shaft 51).

Figure 4A:
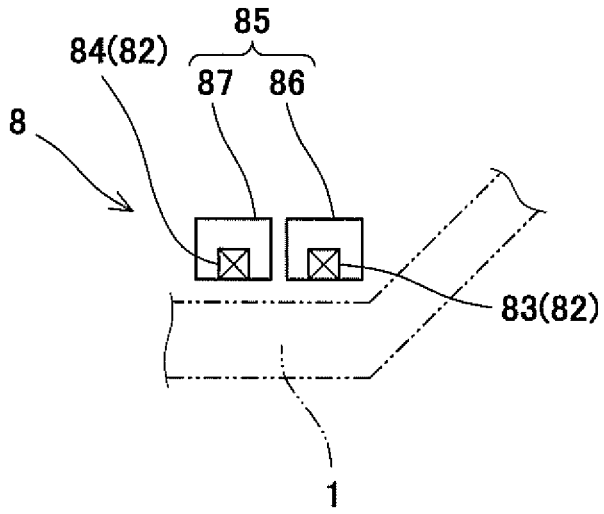
FIG. 4A is a cross-sectional view of a heater.
Figure 4B:
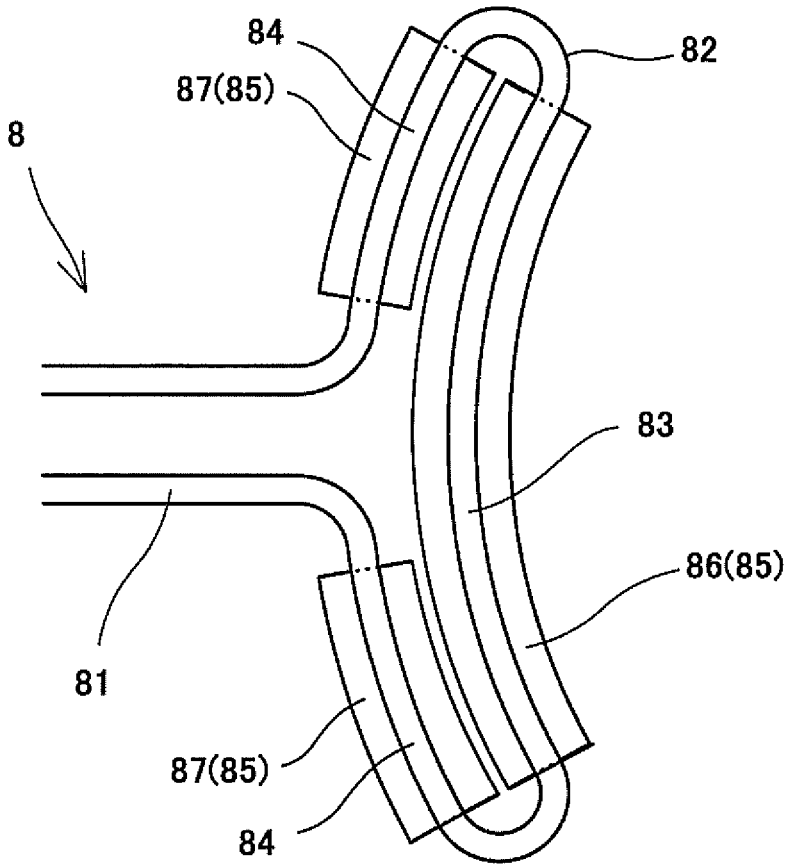
FIG. 4B is a plan view of the heater.

As shown in FIGS. 4A and 4B, the heater 8 includes an electric conducting pipe 81 and a core 85. The electric conducting pipe 81 includes a coil portion 82, and the core 85 collects magnetic flux generated around the coil portion 82. The coil portion 82 has a doubled circular-arc shape extending in a rotational direction of the plate 1 and facing the plate 1. An opening angle (angle between both end portions) of the coil portion 82 is, for example, 60° to 120°. The core 85 is constituted by one inner peripheral piece 86 and two outer peripheral pieces 87. The inner peripheral piece 86 covers an inner circular-arc portion 83 of the coil portion 82 from an opposite side of the plate 1, and the outer peripheral pieces 87 cover respective outer circular-arc portions 84 of the coil portion 82 from the opposite side of the plate 1.

A cooling liquid flows in the electric conducting pipe 81. Further, an alternating voltage is applied to the electric conducting pipe 81. A frequency of the alternating voltage is not especially limited but is desirably a high frequency of 5 k to 400 kHz. To be specific, the induction heating performed by the heater 8 is desirably high frequency induction heating.

Next, operations of the spinning forming device 4 will be explained.

First, the plate 1 is rotated by the rotating shaft 51 with the plate 1 sandwiched between the receiving jig 52 and the fixing jig 61. Next, the processing tool 7 and the heater 8 are moved to respective positions close to the forming start point 30 of the front surface 3 of the plate 1, and the heater 8 locally heats the forming start point 30 of the plate 1. Next, after the processing tool 7 is pressed against the forming start point 30, the processing tool 7 and the heater 8 are moved obliquely downward and outward in the radial direction in synchronization with each other. To be specific, while pressing the processing tool 7 against the front surface 3 of the plate 1 that is rotating, the processing tool 7 is moved outward in the radial direction from the inner side of the projection 13 to a position above the projection 13, and a portion of the plate 1 against which portion the processing tool 7 is pressed is locally heated.

Each of a movement speed V1 of the processing tool 7 in the axial direction of the rotating shaft 51 and a movement speed V2 of the processing tool 7 in the radial direction of the rotating shaft 51 may be constant at all times during the forming. Or, one or both of the movement speeds V1 and V2 may change during the forming.

According to the above operations of the spinning forming device 4, the ironing is performed at the inner side of the projection 13 by the pressing of the processing tool 7. With this, as shown in FIG. 2A, a predetermined range (from the forming start point 30 to the projection 13) at the inner side of the projection 13 of the plate 1 becomes the tapered portion 14.

If the thickness B at the reference position that is a base point of the inner peripheral surface 13*a* of the ring-shaped projection 13 is not so different from the thickness A at the tip end of the projection 13, and the ratio R (=B/A) is higher than 0.7 (in other words, the height of the projection 13 is small), the ironing is performed even in a range where the projection 13 exists. To be specific, the projection 13 just deforms in the axial direction of the rotating shaft 51 by the pressing of the processing tool 7.

On the other hand, according to the present embodiment, the thickness B at the reference position 20 is adequately smaller than the thickness A at the tip end of the projection 13. In addition, the portion of the plate 1 against which portion the processing tool 7 is pressed is locally heated. Therefore, when the processing tool 7 passes through a position above the reference position 20, as shown in FIG. 2B, the bending is performed at a fulcrum that is a portion located at the inner side of and adjacent to the reference position 20 and softened by local heating, and the projection 13 tilts toward the radially inner side. With this, the inward swelling portion 15 is formed at the large-diameter end portion of the tapered portion 14. It should be noted that since the volume of the projection 13 decreases by the tilting of the projection 13 toward the radially inner side, a burr 16 is formed at the outer side of the processing tool 7 by the remaining volume.

To be specific, according to the spinning forming method of the present embodiment, the ironing and the bending can be sequentially performed only by continuously moving the processing tool 7 outward in the radial direction. Therefore, the hollow structure including the inward swelling portion 15 at the large-diameter end portion of the tapered portion 14 can be easily manufactured.

Further, in the present embodiment, since the portion of the plate 1 against which portion the processing tool 7 is pressed is heated from the front surface 3 of the plate 1, the rigidity of the tip end of the projection 13 is maintained. Therefore, the bending at the fulcrum that is the portion located at the inner side of and adjacent to the reference position 20 can be more satisfactorily performed than a case where the portion of the plate 1 against which portion the processing tool 7 is pressed is heated from the back surface 2 side of the plate 1.

It is desirable that the ratio R of the thickness B at the reference position 20 to the thickness A at the tip end of the projection 13 of the plate 1 be 0.2 or more. If the ratio R is too low, the plate 1 may break during the bending depending on the material of the plate 1. The reason why such break occurs is because if the thickness B at the reference position 20 is too small, the plate 1 cannot endure a load of tensile stress generated by the ironing. In contrast, when the ratio R is 0.2 or more, the possibility of such break can be reduced. The ratio R is more desirably 0.3 or more and further desirably 0.4 or more.

MODIFIED EXAMPLES

The present invention is not limited to the above embodiment, and various modifications may be made within the scope of the present invention.

For example, in the above embodiment, the back surface 2 of the plate 1 is constituted by a plurality of flat surfaces each having a linear cross section. However, the back surface 2 of the plate 1 may be constituted by one continuous curved surface.

The back surface 2 of the plate 1 does not necessarily have to include the inward-facing inclined surface 24 at the inner side of the projection 13. For example, as shown in FIG. 5, the reference position 20 that is a position where the inclination of the portion of the back surface 2 which portion extends toward the tip end of the projection 13 is 45° or more may be an intersection point of the outward-facing inclined surface 22 and the inner peripheral surface 13*a* of the projection 13.

It should be noted that when the inward-facing inclined surface 24 exists between the outward-facing inclined surface 22 and the projection 13 as in the above embodiment, a concave portion is formed at the back surface 2 of the plate 1 so as to be located at the inner side of the reference position 20. As a result, especially in a case where the plate 1 is heated from the front surface 3 side, when the ironing shifts to the bending, the heat can reach a portion close to the back surface 2 in a normal direction of the tapered portion 14. With this, the portion located at the inner side of and adjacent to the reference position 20 is kept at a high temperature, and the bending at this portion as the fulcrum can be further satisfactorily performed.

Figure 5:
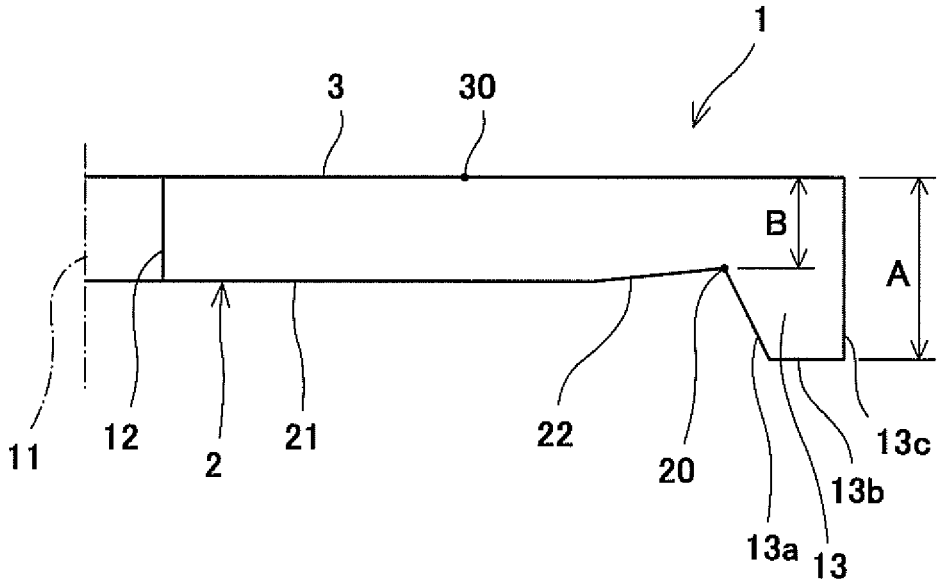
FIG. 5 is a cross-sectional view of the plate of a modified example.
Figure 6A:
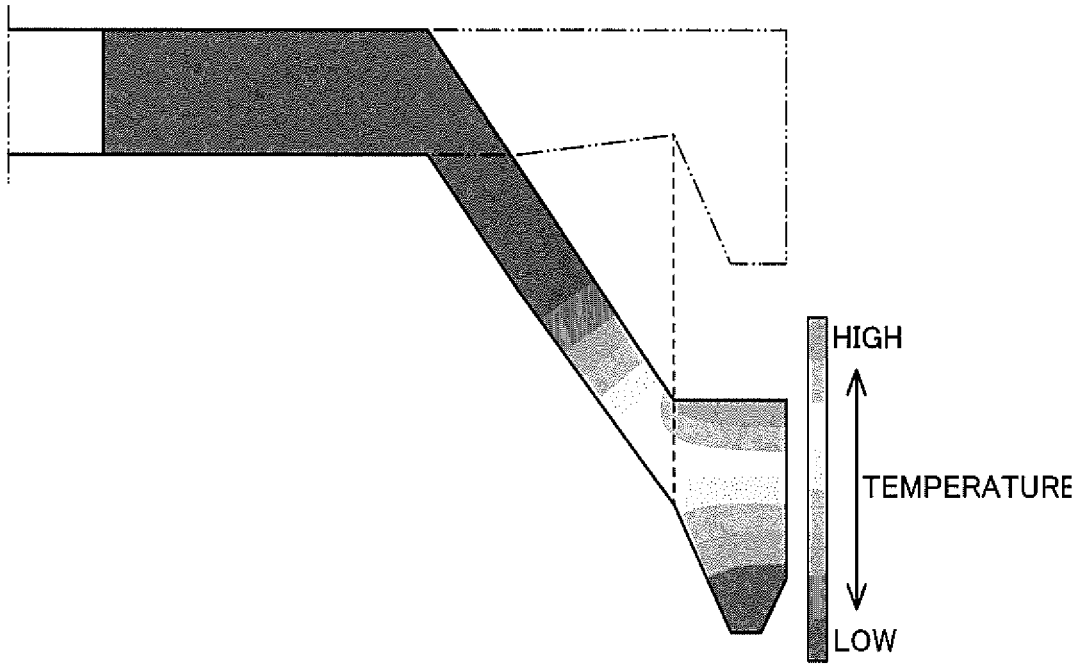
FIG. 6A shows a temperature distribution in the plate of FIG. 5 when ironing shifts to bending.
Figure 6B:
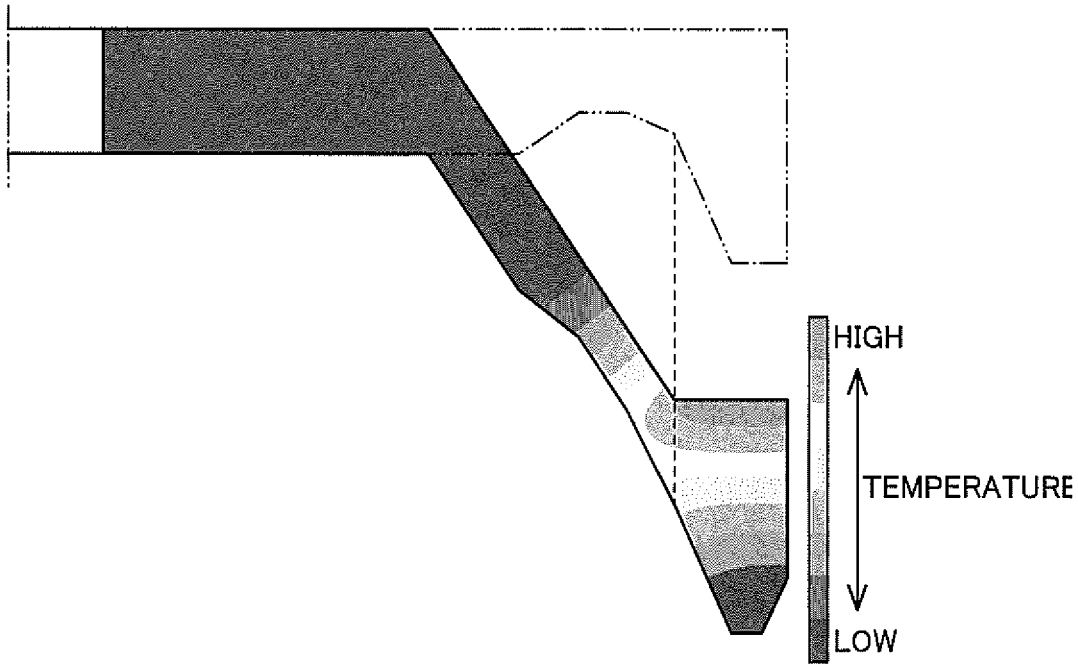
FIG. 6B shows a temperature distribution in the plate of FIG. 1 when ironing shifts to bending.

FIG. 6A shows a temperature distribution in the plate 1 of FIG. 5 when the ironing shifts to the bending. FIG. 6B shows a temperature distribution in the plate 1 of FIG. 1 when the ironing shifts to the bending. The above effects can be confirmed from FIGS. 6A and 6B.

Figure 7:
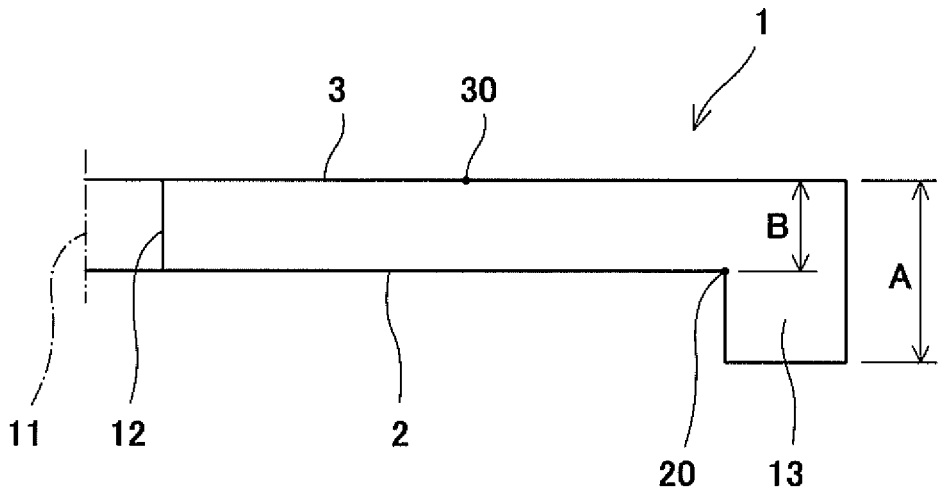
FIG. 7 is a cross-sectional view of the plate of another modified example.
Figure 8:
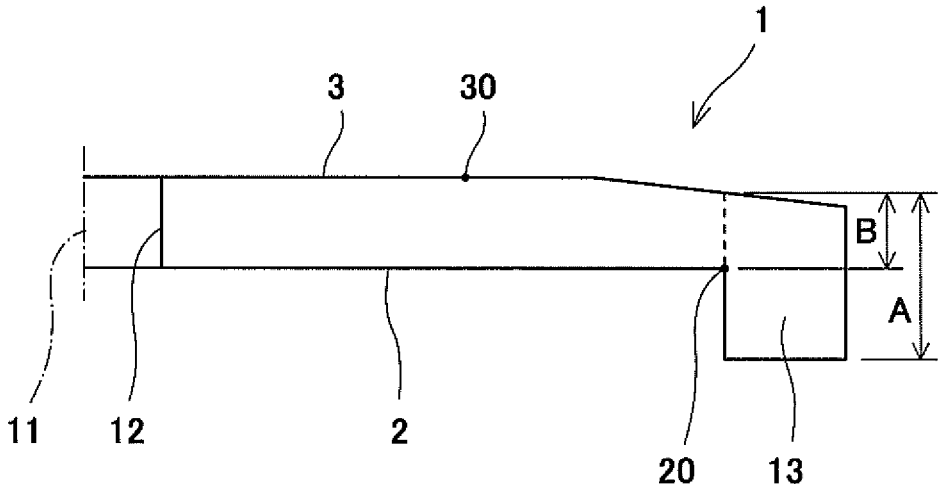
FIG. 8 is a cross-sectional view of the plate of yet another modified example.

The back surface 2 of the plate 1 does not necessarily have to include the outward-facing inclined surface 22 at the inner side of the projection 13. For example, as shown in FIG. 7, the back surface 2 of the plate 1 may be flat except for the projection 13. However, as shown in FIGS. 1 and 5, when the back surface 2 of the plate 1 includes the outward-facing inclined surface 22 at the inner side of the projection 13, in other words, when the plate 1 includes the thinning portion that exists at the inner side of the projection 13 and decreases in thickness toward the radially outer side, the thickness of the plate 1 decreases as the ironing proceeds, and therefore, a load acting on the processing tool 7 during the ironing can be gradually reduced. It should be noted that, for example, as shown in FIG. 8, the thinning portion existing at the inner side of the projection 13 may be a portion between the flat back surface 2 and an outward-facing inclined surface formed at the front surface 3. As shown in FIG. 8, when the front surface 3 of the plate 1 is inclined above the projection 13, the thickness A at the tip end of the projection 13 denotes a maximum distance between the tip end of the projection 13 and the front surface 3.

The cross-sectional shape of the projection 13 does not necessarily have to be a trapezoidal shape. For example, as shown in FIG. 7, the cross-sectional shape of the projection 13 may be a rectangular shape. Or, the cross-sectional shape of the projection 13 may be a triangular shape, a mountain shape (such as a sine curve), or the like.

The minimum thickness of the plate 1 may be less than 10 mm.

REFERENCE SIGNS LIST

1 plate
13 projection
2 back surface
20 reference position
22 outward-facing inclined surface
24 inward-facing inclined surface
3 front surface
30 forming start point
7 processing tool

The invention claimed is:

1. A spinning forming method comprising:

preparing a plate including a back surface at which a ring-shaped projection is formed along an outer peripheral edge of the plate, a ratio of a thickness at a reference position of the plate to a thickness at a tip end of the projection being 0.7 or less, the reference position being a position where an inclination of a portion of the back surface which portion extends toward the tip end of the projection is 45° or more;

rotating the plate;

moving a processing tool outward in a radial direction from an inner side of the projection to a position above the projection while pressing the processing tool against a front surface of the plate that is rotating to perform: (a) ironing at the inner side of the projection, and (b) bending when the processing tool passes through a position above the reference position; and locally heating a portion of the plate against which portion the processing tool is pressed.

2. The spinning forming method according to claim 1, wherein the portion of the plate against which portion the processing tool is pressed is heated from the front surface side of the plate.

3. The spinning forming method according to claim 1, wherein the plate includes a thinning portion at the inner side of the projection, the thinning portion decreasing in thickness toward a radially outer side.

4. The spinning forming method according to claim 3, wherein:

the front surface of the plate is flat at least from a forming start point to the position above the projection; and the back surface of the plate includes an outward-facing inclined surface between the forming start point and the projection, the outward-facing inclined surface being inclined so as to approach the front surface toward the radially outer side.

5. The spinning forming method according to claim 1, wherein the ratio of the thickness at the reference position to the thickness at the tip end of the projection is 0.2 or more.

6. The spinning forming method according to claim 1, wherein the plate is made of titanium alloy.

7. The spinning forming method according to claim 1, wherein a minimum thickness of the plate is 10 mm or more.

8. A spinning forming method comprising:

preparing a plate including:

a back surface at which a ring-shaped projection is formed along an outer peripheral edge of the plate, a ratio of a thickness at a reference position of the plate to a thickness at a tip end of the projection being 0.7 or less, the reference position being a position where an inclination of a portion of the back surface which portion extends toward the tip end of the projection is 45° or more, the projection including a thinning portion disposed at an inner side of the projection in which the thinning portion decreases in thickness toward a radially outer side, and a front surface that is flat at least from a forming start point to a position above the projection;

rotating the plate;

moving a processing tool outward in a radial direction from the inner side of the projection to the position above the projection while pressing the processing tool against the front surface of the plate that is rotating; and locally heating a portion of the plate against which portion the processing tool is pressed, wherein:

the back surface of the plate includes an outward-facing inclined surface between the forming start point and the projection, the outward-facing inclined surface being inclined so as to approach the front surface toward the radially outer side, and the back surface of the plate includes an inward-facing inclined surface between the outward-facing inclined surface and the projection, the inward-facing inclined surface being inclined so as to be away from the front surface toward the radially outer side.

9. The spinning forming method according to claim 8, wherein the portion of the plate against which portion the processing tool is pressed is heated from the front surface side of the plate.

10. The spinning forming method according to claim 8, wherein the ratio of the thickness at the reference position to the thickness at the tip end of the projection is 0.2 or more.

11. The spinning forming method according to claim 8, wherein the plate is made of titanium alloy.

12. The spinning forming method according to claim 8, wherein a minimum thickness of the plate is 10 mm or more.

* * * * *